US006710720B2

(12) United States Patent
Carstensen et al.

(10) Patent No.: US 6,710,720 B2
(45) **Date of Patent: *Mar. 23, 2004**

(54) PRESSURE IMPULSE TELEMETRY APPARATUS AND METHOD

(75) Inventors: Kenneth J. Carstensen, Houston, TX (US); Neal G. Skinner, Lewisville, TX (US); Charles M. Pool, Bedford, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 107 days.

This patent is subject to a terminal disclaimer.

(21) Appl. No.: 10/079,069

(22) Filed: Feb. 21, 2002

(65) Prior Publication Data

US 2002/0140573 A1 Oct. 3, 2002

Related U.S. Application Data

(63) Continuation of application No. 09/056,053, filed on Apr. 6, 1998, now Pat. No. 6,384,738.
(60) Provisional application No. 60/042,783, filed on Apr. 7, 1997.

(51) Int. Cl.[7] ..... G01V 3/00
(52) U.S. Cl. ..... 340/854.3
(58) Field of Search ..... 340/854.3, 853.1, 340/853.3; 367/83, 141

(56) References Cited

U.S. PATENT DOCUMENTS

| | | | | |
|---|---|---|---|---|
| 2,924,432 A | | 2/1960 | Arps et al. | |
| 3,227,228 A | | 1/1966 | Bannister | |
| 3,316,997 A | | 5/1967 | McCocy | |
| 3,613,070 A | | 10/1971 | Jones et al. | |
| 3,622,962 A | | 11/1971 | Winget et al. | |
| 3,708,990 A | | 1/1973 | Crooke | |
| 3,739,845 A | | 6/1973 | Berry et al. | |
| 3,780,809 A | | 12/1973 | Ayers, Jr. et al. | |
| 3,915,256 A | | 10/1975 | McCoy | |
| 3,961,308 A | | 6/1976 | Parker | |
| 3,965,983 A | | 6/1976 | Watson | |
| 4,031,826 A | | 6/1977 | Gemmell et al. | |
| 4,038,632 A | | 7/1977 | Parker | |
| 4,063,215 A | | 12/1977 | Abbott | |
| 4,065,747 A | | 12/1977 | Patten et al. | |
| 4,073,341 A | | 2/1978 | Parker | |
| 4,206,810 A | | 6/1980 | Blackman | |
| 4,445,389 A | | 5/1984 | Potzick et al. | |
| 4,637,463 A | | 1/1987 | McCoy | |
| 4,722,393 A | | 2/1988 | Rumbaugh | |
| 4,945,761 A | | 8/1990 | Lessi et al. | |
| 5,283,768 A | | 2/1994 | Rorden | |
| 5,375,098 A | | 12/1994 | Malone et al. | |
| 5,579,283 A | | 11/1996 | Owens et al. | |
| 5,691,712 A | | 11/1997 | Meek et al. | |
| 6,097,310 A | * | 8/2000 | Harrell et al. | 340/854.3 |
| 6,384,738 B1 | * | 5/2002 | Carstensen et al. | 340/854.3 |

FOREIGN PATENT DOCUMENTS

| | | |
|---|---|---|
| EP | 0 672 819 A2 | 9/1995 |
| GB | 2 281 424 B | 4/1988 |

* cited by examiner

*Primary Examiner*—Timothy Edwards
(74) *Attorney, Agent, or Firm*—Peter Schroeder

(57) ABSTRACT

An apparatus and method of communicating in a tubular system (20) through a media (65) disposed therein and actuating a controllable device (58) are disclosed. The apparatus and method utilize a transmission apparatus (16) at a transmission node that is in communication with the media (65). The transmission apparatus (16) generates pressure impulses that are propagated through the media (65). The pressure impulses may be either positive or negative pressure impulses depending upon the selected transmission apparatus. The pressure impulses are detected by a reception apparatus (77) at a reception node. The detection apparatus may detect the pressure impulses as variation in the media (65) or as variation in the tubular system (20) caused by the pressure impulses. Once the detection apparatus (77) has detected the appropriate pressure impulse or pattern of pressure impulses, a signal may be generated to actuate the controllable device (58).

68 Claims, 12 Drawing Sheets

PRESSURE IMPULSE TELEMETRY APPARATUS AND METHOD

This is a continuation of application Ser. No. 09/056,053 filed Apr. 6, 1998 now U.S. Pat. No. 6,384,738.

CROSS REFERENCE TO RELATED APPLICATIONS

This invention relates to Provisional Application Ser. No. 60/042,783, filed Apr. 7, 1997. The contents of that application are incorporated by reference herein.

TECHNICAL FIELD OF THE INVENTION

This invention relates to systems and methods for remote actuation or control of tools and completion equipment in gas and oil wells, whether in subsurface or subsea locations, for communication and control in measurement while drilling (MWD) systems and associated tools, and for remote control of traveling bodies and stationary elements in pipeline installations.

BACKGROUND OF THE INVENTION

As oil and gas drilling and production techniques have advanced and become more complex and versatile, many different downhole tools have come into use. Some include their own power packs, or other energy sources, and either are or can potentially be operated by remote control. Microprocessors, which are small, reliable and have low power consumption, are commonly used in such toots and equipment. There are many other potential applications for remote control of tools and other equipment within a confining passageway at a substantial distance, including not only in the drilling, completion, workover, production and abandonment of a well, but also in tools and devices that are fixed or movable in pipelines and further with underwater equipment connected to a surface system via a subsea manifold. If commands can reliably be communicated to a remote well bore location, then such functions as opening and closing valves, sliding sleeves, inflating plugs, detonating perforating guns, shifting tools and setting packers are available. Through the use of remote actuation, expensive down time in the well can be minimized, saving the costs of many hours or even days of operation.

Systems have been proposed, and some are in use, for remote control of equipment in well bore installations. A wire connection system using electric line has been in use for some time, and remains in use today. This system employs a heavy duty electrical line that is fed into the well bore along the tubing or casing string to the downhole location. The line is of relatively large diameter and for setup requires a massive carrier and support equipment, with setup time requiring many hours. Moreover, electrical power transmitted into a deep well creates potential dangers from short circuits and arcing in explosive environments at the well site where an inert atmosphere cannot be maintained. A later developed "Slickline" is only a wire for providing mechanical operations and is of much smaller diameter although very high strength. While it can be transported and manipulated by much smaller vehicles and installations, and is deployed considerable more rapidly than the electric line mechanism, it is not well suited to remote operation of downhole tools. Time consuming and unsafe control methods with these systems are based on use of time and motion sequences combined with pressure and temperature readings.

Other systems are known for transmitting non-electrical commands to preinstalled downhole tools by communicating through a pressurized liquid medium or metal walls along the well bore. Pressure variations imparted at the surface of the liquid column are sensed by a strain gauge or other transducer at the remote location, to trigger a battery powered device in response to a coded pressure varying signal. One such system, called the "EDGE" (trademark of Baker Hughes) system, interfaces with liquid media only and injects pulses of chosen frequency into the well bore. A downhole tool having an actuatable element powered at the tool includes electronic circuits which filter the selected frequency from other variations and responds to a selected pattern of pulse frequencies. This system requires substantial setup time and can only be used in a constant and predictable liquid filled bore. Another system effects control of mechanical devices by establishing a high initial pressure and then bleeding off pressure in a programmed fashion.

There is a need, therefore, for a remote control system and method which will function reliably in actuating a remote tool or other equipment, whatever the nature of the media in the confining elongated bore. Preferably, it should be useful in a wide range of well drilling and completion operations, including MWD, and in pipeline applications. The system and method should ensure against accidental triggering of the remote device and be essentially insensitive to extraneous operating conditions and effects. It should also be capable of remote control of selected individual ones of a number of different devices, and providing redundant modes of detection for enhanced reliability and communication capability. While retaining the higher degree of reliability, the system should preferably also require substantially less setup and operating time for field installation and actuation.

MWD installations currently in use require communication with bottom hole assembly (BHA) measuring equipment such as sensors, instruments and microprocessors. The MWD equipment stores information on many parameters including but not limited to bit direction, hole angle, formation evaluation, pressure, temperature, weight on bit, vibration and the like. This is transmitted to the surface using mud pulsing technology. Communicating to the MWD equipment for the purpose of controlling movable elements (i.e. to adjust the stabilizer blades to control direction) is, however, another matter, since not only must commands be given, but they must actuate the proper tool and provide sufficient data to make a quantitative adjustment. The current methods use changes of pump rate, and changes or weight on the bit, both of which take time, are limited in data rate, and increase the chances of sticking the drill string.

Remote control of elements in pipelines is a significant objective, since pipeline pigs are driven downstream for inspection or cleaning purposes and can stick or malfunction. Some pigs include internal processor and control equipment while others are designed to disintegrate under particular conditions. The ability to deliver commands to a pig or a stationary device in a remote location in a pipeline is thus highly desirable.

SUMMARY OF THE INVENTION

The present invention disclosed herein utilizes low frequency, brief pressure impulses of a few cycles duration and very high midterm amplitude to propagate into and through media of different types in a tubular system. The impulse energy transforms during propagation into a time-stretched waveform, still at low frequency, that retains sufficient energy at great depth, so that it is readily detectable by modern pressure and motion responsive instruments.

The system and method provide for communication in the tubular system between a transmission node, where the pressure impulses are generated, and a reception node, at a remote location. The system and method may be used, for example, to actuate a remote tool. The system comprises a transmission apparatus located at the transmission node. The transmission apparatus is in communication with a compressible media such that the transmission apparatus may generate pressure impulses in the media in the tubular system. The system also comprises a reception apparatus that detects the pressure impulses in the media at the reception node in or associated with the tubular system.

The transmission apparatus may generate either positive pressure impulses wherein at least one incremental pressure increase followed by at least one corresponding incremental pressure decrease is propagated through the media, or negative pressure impulses wherein at least one incremental pressure decrease followed by at least one corresponding incremental pressure increase is propagated through the media.

The reception apparatus of the present invention may include sensors for detecting impulse influences or impulse effects, namely variations in the characteristics of the media or the tubular system at the reception node. For example, the reception apparatus may detect variations in the pressure, displacement, velocity, acceleration or fluid density of the media or may detect variations in the longitudinal or circumferential stress, displacement, velocity or acceleration of the tubular system at the reception node. Alternatively, a combination of the above reception apparatuses may be used in redundant and mutually supportive fashion. This redundant capability assures against accidental triggering or actuation of the remote tool. Impact forces and pressures generated mechanically or transmitted from other sources through the surrounding environment are thus unlikely to affect the remote tool.

When the system and method of the present invention are utilized to actuate a remote tool, an actuation signal is generated by the reception apparatus in response to the detection of a pressure impulse. Optionally, a plurality of pressure impulses in a predetermined pattern may be generated and then compared to information stored in a control system for the remote tool to determine whether the pattern of impulses is intended to actuate that remote tool.

The system and method of the present invention thus impart a pressure impulse with sufficient energy to assure propagation along the tubular system to deep target locations. The received pressure impulses are so modulated and distinct as to provide a suitable basis for redundant transmissions, ensuring reliability. The system is tolerant of the complex media variations that can exist along the path within the well bore. Differences in wave propagation speed, tube dimension, and attenuation do not preclude adequate sensitivity and discrimination from noise. Further, using adequate impulse energy and distributed detection schemes, signals can reach all parts of a deephole installation having multiple lateral bores.

In a pipeline installation, the system and method of the present invention are particularly effective because with the uniform media in the pipeline, an impulse can traverse a long distance. Thus, an instrumented or cleaning pig can be commanded from a remote source to initiate a chosen control action or pig disintegration.

The system and method of the present invention are particularly suitable for MWD applications, which include not only directional controls, but utilize other commands to modify the operation of downhole units. The MWD context may utilize the pressure impulse encoding capabilities of the present invention to compensate for the dynamic-variations that are encountered by the MWD equipment during operation.

The system and method are also applicable to subsea oil and gas production installations, which typically interconnect a surface platform or vessel via pipelines to a seafloor manifold system communicating with subterranean well bores. By transmitting pressure impulses from the surface, systems on the seafloor and downhole tools can be addressed and controlled via the pipelines.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
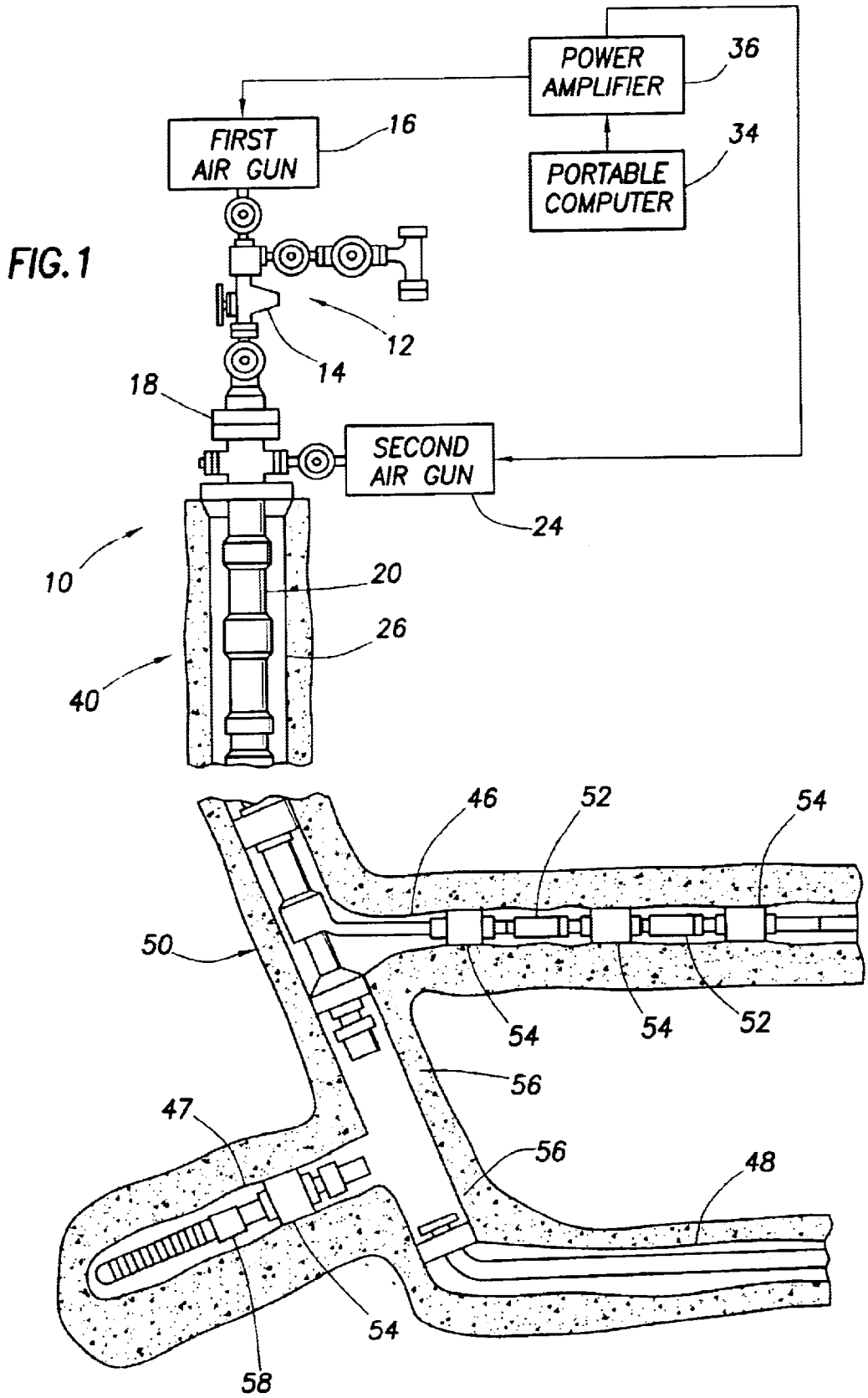
FIG. 1 is a combined block diagram and perspective view of an exemplary system in accordance with the invention.

Systems and methods in accordance with the present invention are depicted in FIG. 1 and include an impulse generating system 10 at a transmission node such as well head 12. At the well head connection 14, the impulse generating system 10 includes a first air gun 16 coupled via a flange 18 into the center bore of the tubing 20 in the well. This connection can be made into any of a number of points at the wellhead, such as a crown/wing valve, a casing valve, a pump-in sub, a standpipe or and other such units. The impulse generating system 10 also may include, optionally or additionally, a second air gun 24 coupled at a flange into the annulus between the tubing 20 and the well casing 26.

The impulse generating system 10 generates pressure impulses that propagate down a tubular system such as, for example, the interior of the tubing 20 or the annulus between the tubing 20 and the well casing 26 through the gas or liquid media therein. The pressure impulses generated by impulse generating system 10 are positive pressure impulses that include at least one incremental pressure increase followed by at least one corresponding incremental pressure decrease that propagates through the media. Alternatively, the pressure impulses may be negative pressure impulses that include at least one incremental pressure decrease followed by at least one corresponding incremental pressure increase that propagates through the media as discussed with reference to FIGS. 11–14 below.

It should be noted by those skilled in the art that impulse generation system 10 also generates acoustic energy that propagates down the well bore 40 through, for example, the tubing 20 and the well casing 26. The energy associated with the acoustic transmission moving along these paths will be of a lesser order of magnitude, however, than the energy associated with the pressure impulse propagating through the tubular bounded fluid media.

Within the tubular systems, such as tubing 20 and/or the annulus between tubing 20 and well casing 26, the fluid media may comprise compressible fluids, substantially incompressible fluids or combinations thereof. For example, the fluid media may comprise oil, an oil-water mix that may include gas bubbles, oil or water to a predetermined level that is below a gas cap, a complete gas path, a gas/foam mix, or a typical operating fluid, such as a drilling mud that may contain substantial particulate and other solids. Using the impulse generating system 10 of the present invention, communication through any such media is achieved. As the specific nature of the fluid media in any particular installation is generally known, the impulse generating system 10 of the present invention may be suitably configured to transmit pressure impulses through all typical fluid media.

Figure 4:
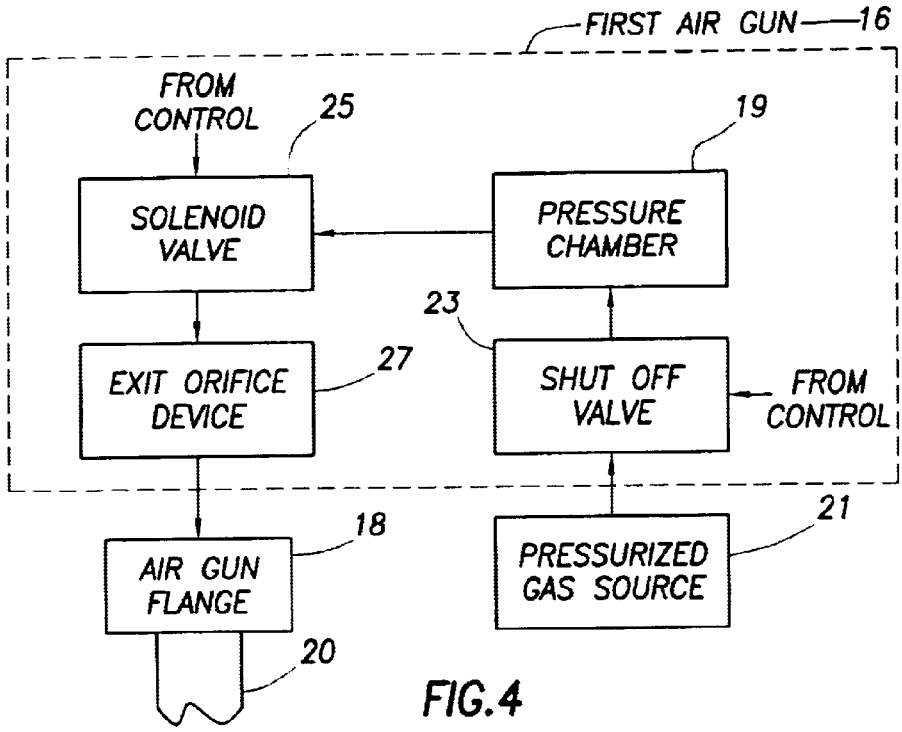
FIG. 4 is a block diagram of an impulse generating system of the present invention.

The term "air" gun is used herein to connote a gas phase pressure impulse generator for introducing high intensity pressure impulses into the fluid media, even though other gases than air are typically used. For example, compressed nitrogen and sometimes carbon dioxide are preferred, so that if mixed with a flammable source, a flammable environment is not created in or around the well. Referring now to FIG. 4, each air gun 16 or 24 includes pressure chamber 19 which is pressurized by gas from a pressurized source 21 supplied via a shut off valve 23 which decouples the connection under control signals. The output from the chamber 19 is gated open by a fast acting solenoid control valve 25 receiving actuating pulses from the control to deliver highly pressurized gas from the chamber 19 through an exit orifice device 27 into the flange 18 or other coupling. The exit orifice 27 is preferably variable in size and shape to provide a controllable parameter for the impulse generating system 10. The source 30 advantageously contains a commercially available inert and non-flammable gas such as nitrogen at a high pressure (from 200 to 15,000 psi). Nitrogen bottles at 2,000 psi are commonly available and will provide adequate pressure for a high proportion of applications. A higher pressure source or a gas intensifier pump may also be used for higher pressure application along with a pressure regulator (not shown) to control the energy level of the pressure impulses generated by the impulse generating system 10. The use of higher pressure levels transmits a pressure impulse having greater energy and ability to propagate to remote locations through the fluid media.

The volumetric pressure chamber 19 in the air guns 16, 24 comprises an impulse transformer, which may incorporate a movable piston wall (not shown) or other element for adjusting the interior volume. An interior volume of from 2 $in^3$ to 150 $in^3$ is found to be adequate for the present examples, although other volumes may be advantageous depending on the application. The greater the volume, the higher the energy level delivered. In operation, the air guns 16, 24 are gated open, the valve 25 motion requiring a short interval, typically a few milliseconds (MS), to allow the pressurized gas to expel from the chamber 19. This pressure release generates a pressure impulse with sharp leading and trailing edge transitions and a high mid-term amplitude. It should be noted that the air guns 16, 24 may optionally and additionally be gated closed to enhance the trailing edge transition of the pressure impulses. In any event the valve 25 is again closed to allow the chamber to be pressurized for the next pressure impulse.

The output from the air gun 24 is variously referred to herein as a "pulse burst", "pressure impulse", "pneumatic impulse", "shock impulse" and by other terms as well, but all are intended to denote the variations occurring upon sudden transfer of pressurized fluid within a surface location in the system for downhole transmission to a remote location.

Referring again to FIG. 1, control signals for generating the pressure impulses from the impulse generating system 10 are initiated as outputs from a portable computer 34 and amplified via a driver amplifier 36. The computer 34 can be used to calculate the energy needed for the pressure impulse to propagate to the desired remote location within the tubular system, given the well bore diameter and length, well interior volume including lateral bore holes, and known practical parameters, such as the characteristics of the fluid media in the well bore including the locations of any interfaces between compressible fluids and substantially incompressible fluids, e.g., a gas/liquid interface. From these factors and prior relevant experiments, the air gun variables can be selected, including the differential pressure level at the pressurized gas source 21, the volume of the chamber 19, the size and shape of the orifice device 27 and the open time for the solenoid valve 25 The pressure impulse generated by the impulse generating system 10 is converted, because of gas compressibility and the dynamics of gas movement through the chamber 19, into the pressure impulse of a few cycles of rapid rises and declines in amplitude to and from a peak amplitude cycle (e.g., waveforms (A) in FIGS. 5, 6 and 7).

Whether the first air gun 16 or the second air gun 24 is used will be determined by the operator, depending upon the downhole tool to be operated, the most efficient transmission path and signal receiver position in the tubing 20 or annulus. Even though FIG. 1 has depicted the impulse generating system 10 as having two air guns 16, 24, it should be understood by those skilled in the art that any number of air guns may be used for the generation of pressure impulses. For example, two air guns may be attached to well head 12 such that both have communication paths to the fluid media within tubing 20. These two air guns may then be fired simultaneously or in a predetermined sequence to generate one or more pressure impulses having the desired characteristics. More specifically, the two air guns may be configured to have different interior volumes, different pressure levels or different orifice sizes such that the remote signal detection devices may distinguish between the pressure impulses from each of the air guns.

The well bore 40 below the well head 12 comprises typically a conventional tubing 20 and exterior casing 26 within a cement fill. Lateral bore holes 46 and 47, which may be greater or lesser in number, extend from the well bore 40. The fluid media 65 in the well bore 40 may be, for example, gas, air, foam, water, oil, drilling mud or combinations thereof.

In the lower regions of the well, various remotely controlled tools are shown in lateral bores 46, 47 that branch off from the main bore 40, which extends at its lowest elevation into a horizontal extension 48. At a selective re-entry and diverter system 50, the first lateral bore 46 diverts horizontally to a hydrocarbon bearing region, as seen in idealized form. Along lateral bore hole 46, the tubing 20 includes remotely controlled sliding sleeves 52, separated by external casing packers 54 to provide zonal isolation. At the second lateral bore hole 47, a different illustrative example is shown, in which the branch is bounded in the main bore by a pair of casing packers 56, while in the lateral bore 47, a distal remotely controlled valve 58 is isolated by an external casing packer 54. Similarly, in the main Well bore 40, another remotely controlled valve 60 is below the lower casing packer 56. Since there may be a number of lateral bores (as many as eight have been attempted) as well as a number of tools in each branch, the capability for command and control of different tools and equipment in each branch at different depths requires high energy levels as well as advanced signal encoding and detection. Each of these tools at the various locations is considered to be a separate reception node, requiring different signals for actuation. These objectives are realized by systems and methods in accordance with the present invention.

In an exemplary test system, referring now to FIG. 2, the fluid media 65 comprised water rising to a level approximately (136 feet) below the well head 12, established a gas/liquid interface 67 at the water surface, while an uppermost air gap of 136 feet remained. In addition to the fluid media 65, through which the pressure impulse is propagated, acoustic paths might exist to some degree along the steel walls defined by the tubing 20 and downhole casing 44. The degree to which the acoustic energy is communicated into the metal is dependent upon many factors not significant here, such as the physical geometry, the impedance matching characteristics, and steel wall thickness and physical properties. The interior cross-sectional dimensions of the tubing 20, the well bore 40 and the annulus therebetween, however, are the most significant factors in transforming the impulse energy into an extended pattern having "tube wave" components about some nominal center frequency. The other most significant factor is the characteristic of the fluid medium along the length of the well bore 40 through which the pressure impulse propagates.

Since it is usually known whether the media is liquid, gas, or successive layers of the two, or contains particulate or other solids, and since well depth is known, the attenuation can be estimated and the pressure impulse can be adjusted accordingly. In all instances, as the pressure impulse travels through the tubular system, the pressure impulse transforms following a generic pattern. The pressure impulse is not only diminished in amplitude but is spread out in time, and the brief input cycles transition into the "tube wave." The "tube wave" is a sequence of high amplitude acoustic wave cycles at a low frequency approximately determined by the diameter of the tubular system. These "tube waves" contain ample energy at the deep downhole location to generate signals of high signal-to-noise ratios.

Since the length of a deep well is many thousands of feet, the brief pressure impulse, when sufficient in amplitude, has ample residence time when propagated along the longitudinal sections within the confining tubular system to transform to a preferential frequency range. Usually this will be below about 200 Hz, typically below the 60 Hz range depending upon the diameter of the tubular system and the characteristics of the fluid media therein.

The propagation speed of the pressure impulse varies in accordance with the characteristics of the fluid media along the propagation path. This speed is significantly different for different fluid media and is compared to the speed of acoustic propagation in steel (all in feet per second) as follows:

| | |
|---|---|
| Air (or CH4 or other gas) | 1100 fps |
| Seawater | 5500 fps |
| Oil | 5000 fps |
| Drilling mud | 5500–8000 fps |
| Steel tubing/casing | 18000 fps |

Figure 3:
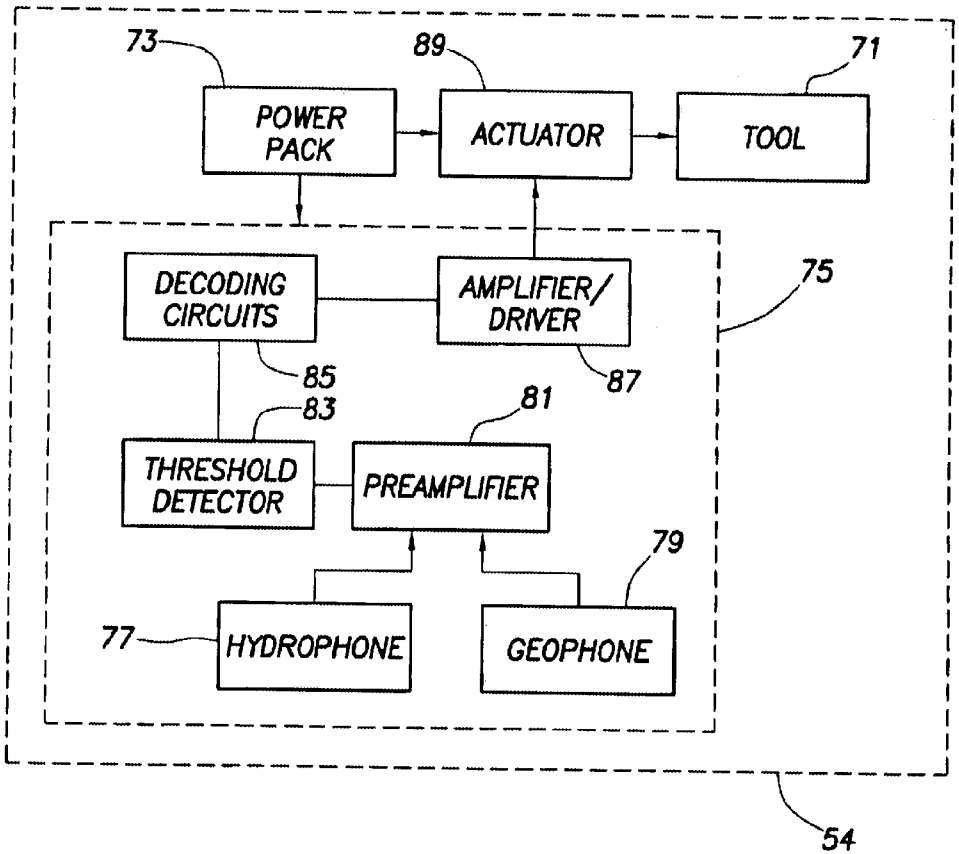
FIG. 3 is a block diagram representation of a remotely controllable tool, self-powered, for use in conjunction with a system of the type of FIGS. 1 and 2.

At the reception node in the well bore 40, including tools 70, flow controllers and other equipment are positioned at a known depth. The specific tool in one illustrative example, referring now to FIG. 3, is a well perforating gun 71, arranged together with its own power pack 73, such as a battery. Signal detection and control circuitry 75 are also disposed at the remote tool 70, also being energized by the power pack 73. The detection and control circuitry 75 at any reception node may include a hydrophone 77, which responds to pressure amplitude variations, and a geophone 79 or seismometer-type device which responds to changes in velocity of the fluid media 65. As an example, ceramic or crystal microphones (not shown) have been found to be particularly suitable. The control circuitry 75 also includes pre-amplifiers 81, threshold detection circuits 83, decoding circuits 85 and amplifier/driver circuits 87. The output energizes an actuator 89 which may receive power signals from the power pack 73, to trigger the well perforating gun 71 or other tool.

Figure 5:
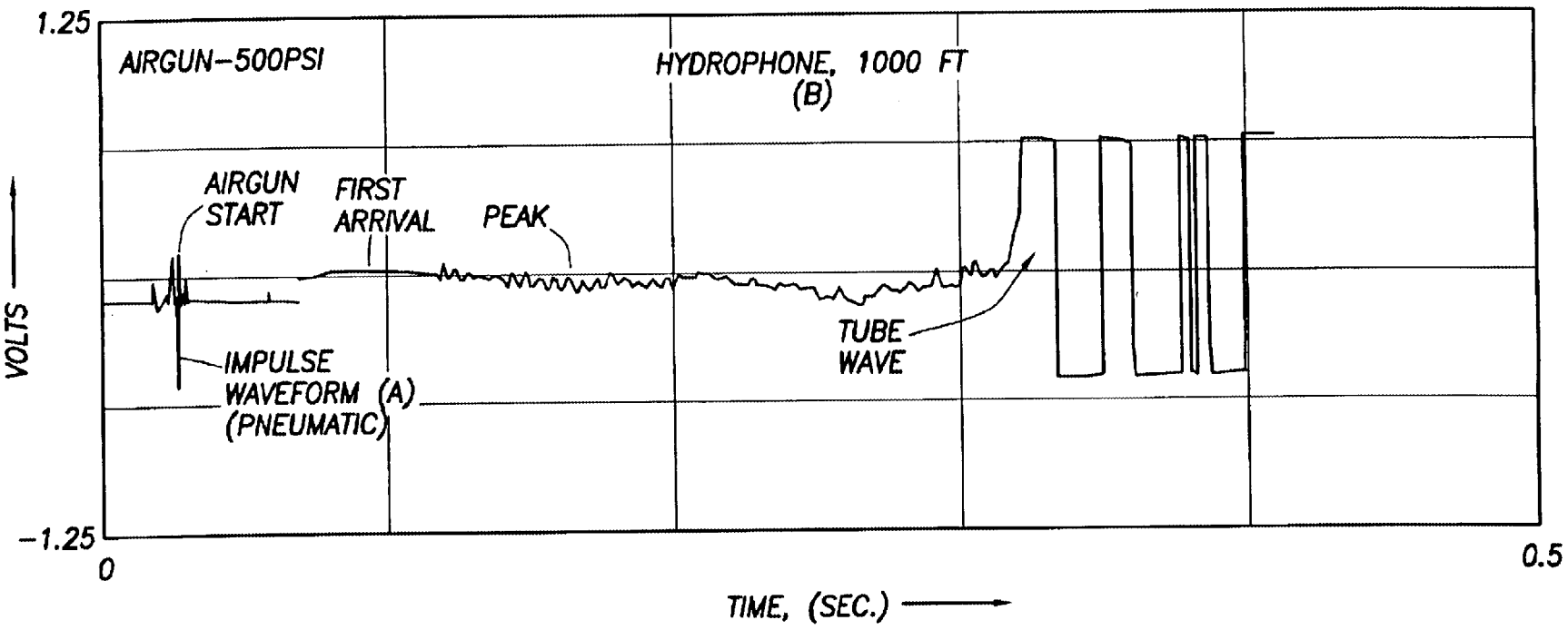
FIG. 5 is a graph of signal waveforms as transmitted and received in a first test in the test installation.
Figure 6:
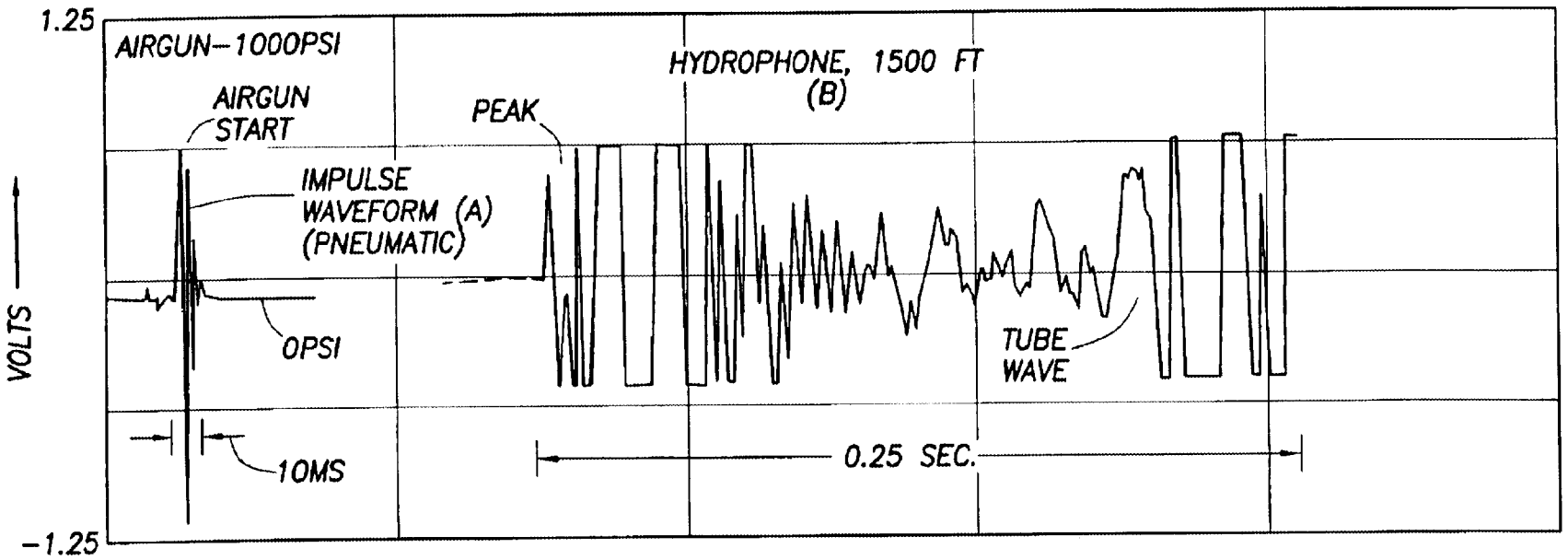
FIG. 6 is a graph of signal waveforms as detected at depth in a second test under different conditions in the test installation.
Figure 7:
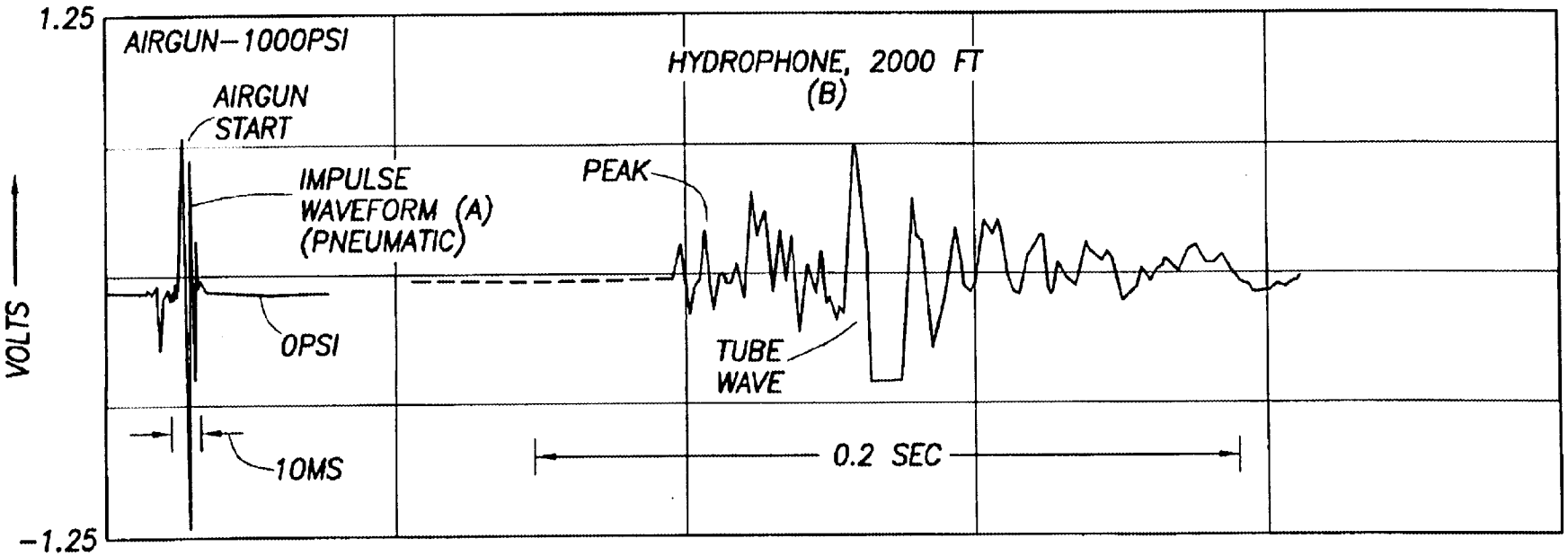
FIG. 7 is a graph of signal waveforms as detected at depth in a third test in the test installation in accordance with the invention.

At the surface, signals received at the hydrophone 77 were transmitted uphole via an electrical support line 91 and then recorded and analyzed at response test circuits 93, enabling the charts of FIGS. 5 to 7 to be generated. The signal detection and control circuitry 75 is configured to respond to the pressure impulses reaching the downhole location in a time-extended, somewhat frequency-centered form, as shown by waveforms (B) in FIGS. 5, 6 and 7. The amplitude of the pressure impulses, as well as the time pattern in which wavetrains are received, are the controlling factors for coded signal detection. Since it is not required to detect signal energy at a particular frequency or to measure the time span of the signal, signal filtering need not be used in most cases. However, if ambient noise is a consideration when higher frequency components are present, then a low frequency pass filter may be used. Tube waves have been measured to be in the range of about 40–60 Hz, so an upper cutoff limit on the order of 200 Hz will suffice for such conditions. Moreover, conventional signal processing techniques can be utilized to integrate the signals received, thus providing even greater reliability.

The concurrent use of multiple detectors such as the hydrophone 77, the geophone 79, the ceramic crystal microphone and an accelerometer are usually required for an adequate signal-to-noise ratio. However, since the nature of the modulation and attenuation introduced during transmission of the pressure impulse from the well head 12 cannot be exactly known, there is some benefit to be derived from utilizing confirmatory readings. A second detector or a third detector can be used simultaneously together with signal verification or conditioning circuits, to enhance reliability. If both the pressure amplitude variation from the hydrophone 77 and the velocity variation represented by the output of the seismic-type detector 79 (geophone or accelerometer) are consistent, then the pressure impulse signal has been even more assuredly identified than if a single transducer alone is used.

The encoded signal pattern that is generated at the air gun 16 or 24 for remote detection and control is usually in a format based on a binary sequence, repeated a number of times. Each binary value is represented by the presence of a pressure impulse (e.g., binary "1"), or the absence of a pressure impulse (e.g., binary "0"), during a time window. Thus, if a binary sequence of 1,0,0,0,1 is used to designate a particular remote tool 70, then there will be pressure impulses only in the first and fifth time windows.

The preprogramming of different remote tools or equipment can be based on use of a number of different available variables. This flexibility may often be needed for multilateral wells, where a single vertical well is branched out in different directions at different depths to access adjacent oil bearing formations. Here, the use of paired different signal transducers enables more reliable detection of lower amplitude signal levels. Moreover, the signal patterns can employ a number of variables based on pressure, time, orifice configuration and chamber volume to enable more code combinations to become available. For example, using a pressure regulated source, the starting pressure impulse can be given varying waveforms by changing pressure (e.g., from 2.000 psi to 3,250 psi) using the same chamber size. The stored pattern of the remote microprocessor will have been coded to detect the specified signal. Likewise, chamber volume can also be varied within a signal sequence to provide predictable modulation of downhole wavetrains.

The time gap between the time windows in the first example may be determined by the duration needed to establish non-overlapping "sensing windows" at the remotely controlled device, as seen in FIG. 8(A). As the pressure impulse travels down the well bore 40, pressure energy components in the fluid media 65 will be more slowly propagated than acoustic energy components moving along the tubing 20 or casing 26. The sensing, windows, and therefore the initiating time windows, are, however, spaced enough in time for propagation and reception of the slowest of the received signal sequences, without overlap of any part of the signals with the next adjacent signal in the sequence. In other words, after one pressure impulse has been generated at well head 12, sufficient time elapses as that pressure impulse is propagated down the well bore 40 for another pressure impulse to be generated while the first is still en route. Once a first pressure impulse has been received, the remaining sensing windows can be timed to start at reasonable times prior to the anticipated first arrival of the next pressure impulse. However, until the first pressure impulse is received, the receiving circuits operate as with an indefinitely open window.

Figure 8:
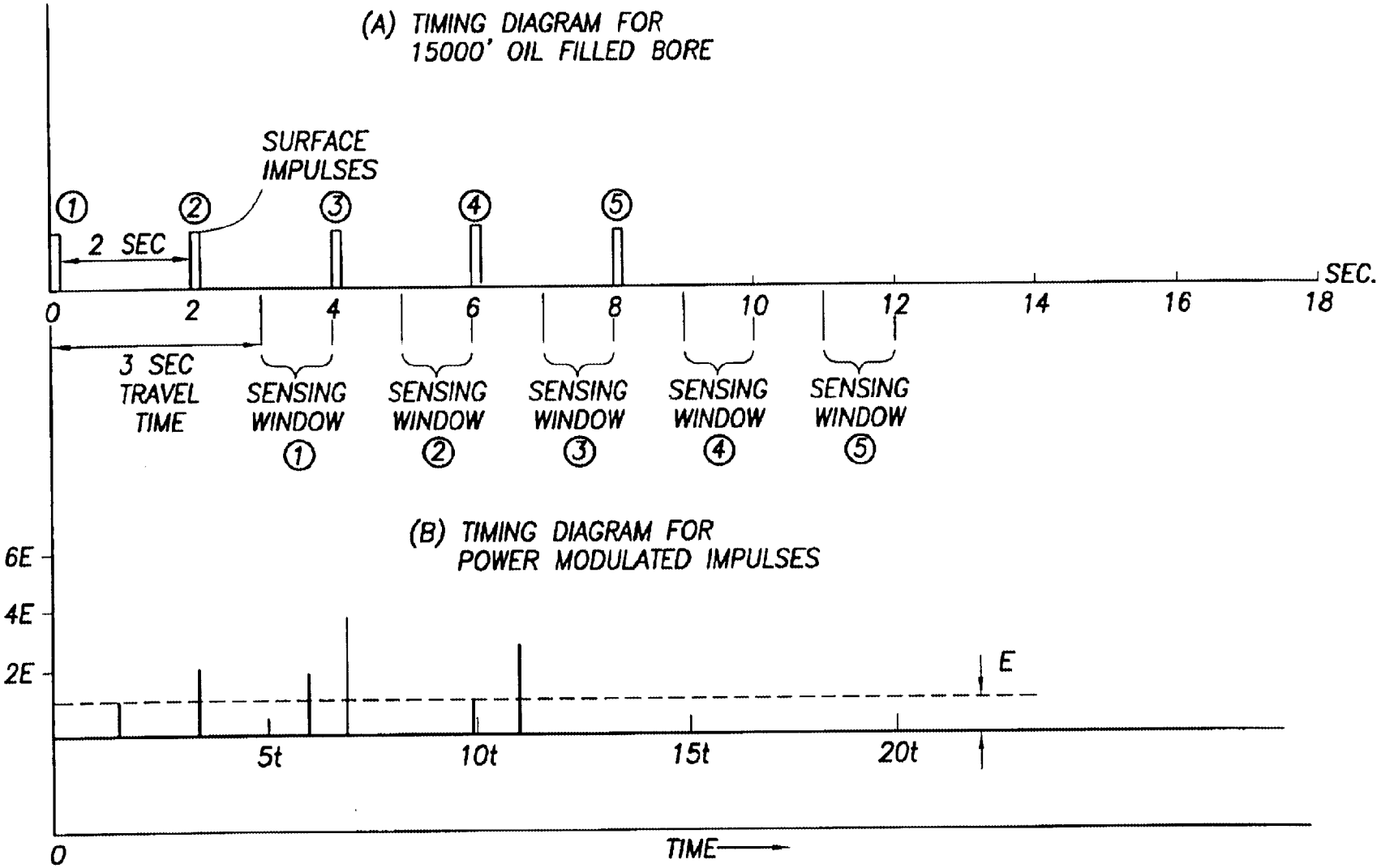
FIG. 8 is a graphical representation of timing relationships observed in a system in accordance with the invention.

Another variant, shown at waveform B in FIG. 8, incorporates the aforementioned technique of modulating signal power in the pressure impulses in a sequence, while also maintaining time separation between them to avoid noise and interference. In FIG. 8(B), the pressure impulses are always separate by a time (t) adequate to avoid noise and overlap interference. The absence of a pressure impulse in a given time cell, of course, also may represent a binary value. Furthermore, the impulse energy may be varied by multiples of some base threshold (E), which is of sufficient amplitude for positive detection not only of minimum values but the incrementally higher values as well.

These timing relationships as depicted in FIG. 8 are somewhat idealized for clarity. Once the proper time-distributed sequence of pressure impulses is received, a triggering pulse from the decoding circuits 85 (FIG. 3) through the amplifier/driver circuit 87 signals the actuator 89, initiating the operation of perforating gun 71. Before triggering the tool, however, the sequence or code input may be repeated a predetermined number of times, including at higher or lower air gun pressures and chamber volumes as selected to ensure against accidental operation. A typical example of a system, for a 15,000 foot deep well bore, can provide in excess of 16, but fewer than 32, remotely operable tools. For this number of tools, 32 or ($2^5$) binary combinations are sufficient, meaning that the coded signals can comprise repeated patterns of six binary digits each if pressure impulses of equal energy are used. Fewer pressure impulses are needed if amplitude modulation is used as well.

Figure 2:
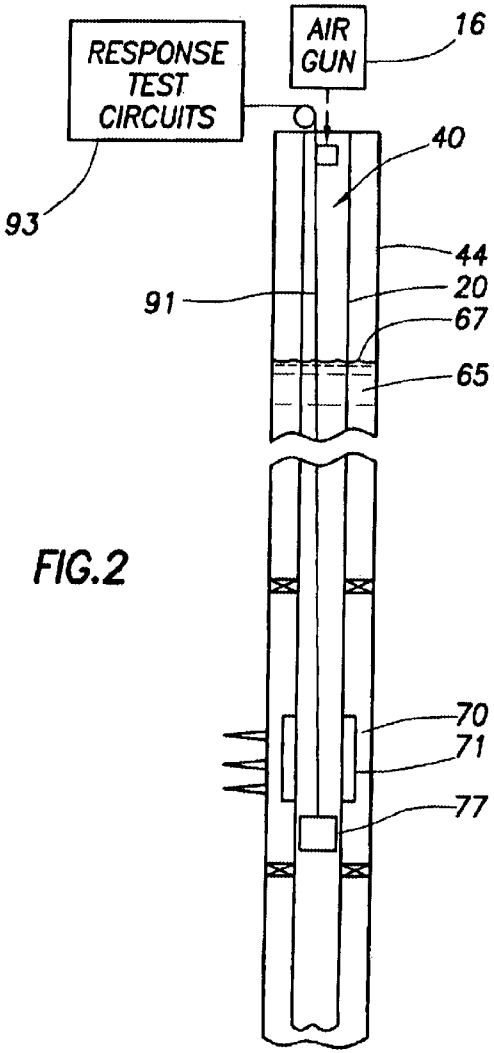
FIG. 2 is a partially diagrammatic side sectional view, simplified and foreshortened, of a test system used in a well bore installation.

FIGS. 5–7 illustrate transmission and detection of pressure impulses in a test well such as shown in FIG. 2, under different conditions, but all having an air gap of 136 feet interfacing with a much greater depth of water below. The sensitivity of commercially available hydrophones is such that, given the energy and characteristics of a pressure impulse in accordance with the present invention, a signal level of high amplitude and adequate signal to noise ratio can be derived at a deep well site. For example, a pressure fluctuation of 1 psi generates a 20 volt output so that if the pressure variation is an order of magnitude less (0.1 psi), the signal generated is still 2 volts, which with modern electronics constitutes a very high amplitude transition. The sensitivity of a modern commercial geophone in response to velocity variations is also high, even though less in absolute terms, being in the order of 20 volt/(in/sec) or 0.2V for a velocity of 0.1 in/sec.

Consequently, a brief pressure impulse, time distributed over a longer interval and converted to a "tube wave" is readily detected at a deep subsurface location. This is true even though pressure impulses are more efficiently transmitted in a pure liquid a substantially incompressible fluid, as opposed to a gas, which is compressible, or in a mud, which contains reflective particulate.

In the example of FIG. 5, the pressure impulse was derived from a pressurized $CO_2$ source directed through a 3 $in^3$ chamber and suspended at a depth of approximately 11 feet below the surface of the well bore 40. The pressure impulse (waveform A) at a given pressure was converted to the hydrophone outputs at the depths indicated. (Note that the pressure impulse is not on the same scale as the detected electrical signal.) Typically, the higher amplitude half cycles of the pressure impulse were at such levels that the detected signals were amplitude limited (i.e., "clipped") on the recorded pattern because they exceeded the recording limit of the receiving mechanism. The clipping level was at about 0.6 volts.

Referring to FIG. 5, in which the air gun pressure was at 500 psi and the hydrophone at. 1,000 feet, it can be seen that the pressure impulse had a substantial amplitude for a duration on the order of 10 ms. starting about 25 ms from time zero on the graph. Transmission through the well bore 40 substantially extended the time duration of the pressure impulse, into a preliminary phase after first arrival that lasted for 0.2 seconds before the high amplitude tube wave was detected.

The example of FIG. 6 shows the results of operating the air gun at a 1,000 psi pressure with the hydrophone at 1,500 feet. The air gun generated an input pressure impulse of substantially greater input amplitude than that described above with reference to FIG. 5. The "first arrival" time elapsed is, however, shown only as a dotted line and the time base is unspecified because although the waveforms are correct, the processing circuits did not adequately delineate the time delay before first arrival. Nonetheless, the "tube waves" occurring over extended time spans in response to the input pressure impulse peaks reached the hydrophone 77 and generated the waveform shown, with each vertical division representing a 0.1 second interval (except as to first time arrival).

The pressure impulse (A) in FIG. 7 is again generated with the air gun at 1,000 psi pressure so that the pressure impulse profile corresponds to that of FIG. 6. The time before first arrival seas again not precisely ascertainable but the detected waveform thereafter is correct. The detected amplitude at 2,000 feet diminished from that detected at 1,500 feet, but still was on the order of one volt. This again illustrates the principle that, given that multivolt signals can be accurately detected, there is adequate energy for transmission to remote downhole locations. Accordingly, dependent upon both the depth and the fluid media 65 through which pressure impulses are to be transmitted, the energy output of the air gun can be substantially increased by higher pressure and higher chamber size so as to provide reliable distribution through a deep well system. Additionally, orifice size and shape may be varied to alter the characteristics of the pressure impulse.

For an exemplary 15,000 depth, filled with liquid hydrocarbons, each binary code combination requires a time window (and a corresponding sensing window) of approximately 1.0 seconds, assuming a minimum propagation time of 3.0 seconds. With respect to the timing diagram of FIG. 8, a difference, or time window, of 2 seconds between surface pressure impulses readily avoids overlaps at the remote location. When providing five successive binary sequences in this fashion, while adding an extra interval to distinguish the different binary sequences, the total actual testing interval is only on the order of 2.5 minutes. This is virtually the entire amount of operating time required if the air guns are preinstalled. Added time would be needed to set up air gun connections at the well head 12, but if flange couplings and shutoff valves have been provided, the couplings can be made without delay.

Using commercial hydrophones and geophones, useful outputs are derived under deep well conditions. In the test installation, the hydrophone output is approximately 2 volts and the geophones output is 0.2 volts, each of which readily facilitates signal detection.

Figure 9:
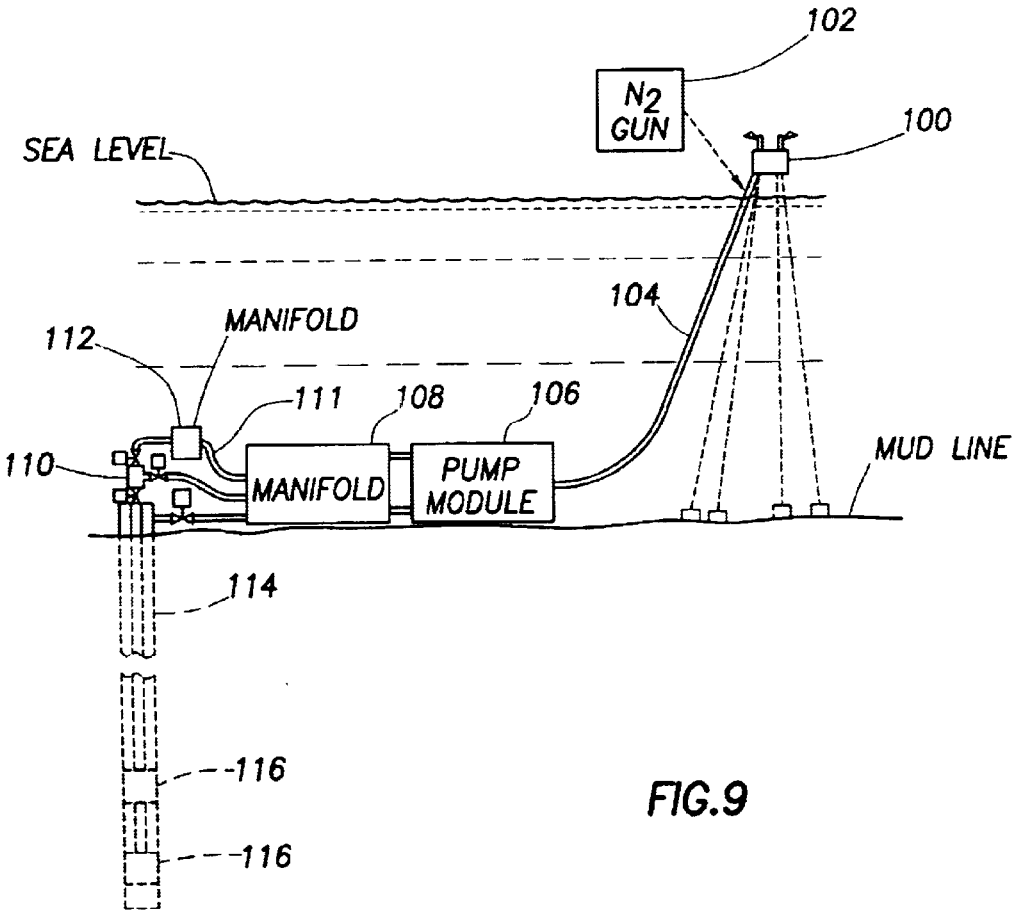
FIG. 9 is a simplified example of a system in accordance with the invention as used in a subsea installation.

As illustrated in FIG. 9, to which reference is now made, the remote control system and method are applicable to subsea applications in a variety of forms. A platform 100 of the floating or seafloor mounted type, supports an $N_2$ gun 102 coupled at or near the apex of a gathering pipeline 104. Mounted on the sea floor are a pump module 106 coupled to the gathering pipeline 104, and a manifold 108 in communication with a crown valve 110 via a tubing 111 which includes a manifold jumper valve 112. The crown valve 110 and the manifold jumper valve 112 may be controlled by a hydraulic system, or remotely using pressure impulses, in the manner previously described. When opened, however, these elements provide a communication link for transmission of pressure impulses into a subsea well 114 in which downhole tools 116 are positioned. These may be sleeves, valves and various other tools in the main well bore or in multilateral branches.

As previously described, complex pressure impulse signal patterns can both address and actuate equipment on the sea floor as well as downhole tools. The sea floor systems include not only the subsea manifold 108 and the pump 106, but also subsea separation processing modules and subsea well controls. The remote control system can alternatively be a secondary control for subsea trees and modules, where the primary control system is most often a combination of electric communication and hydraulic actuation units.

In the development of production systems, there has been a trend toward replacing platforms with floating vessels for production, storage and off-loading applications. Such vessels can process the flow to reduce water and gas content and then deliver the product to shuttle tankers or onshore locations. Again, subsea modules including manifolds, valving systems and pumps, can control operations and flows from a number of different well bores. In these applications, remote control of units, tools and other equipment on the sea floor or in the well bores can be extremely useful for deep water subsea completions.

Figure 10:
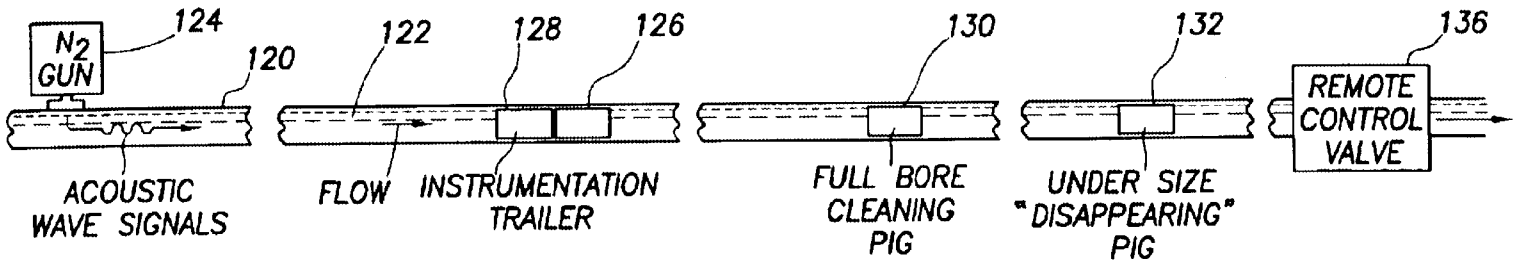
FIG. 10 is a simplified example of a system in accordance with the invention for a pipeline application.

Whether a pipeline is on the surface or buried, an ability to command and control remotely can be very useful. The operation of an impulse generating system of the present invention is, therefore, applicable for a variety of unique purposes in the pipeline installation. A pipeline 120, referring now to FIG. 10, which may extend for a long distance, incorporates an $N_2$ gun 124 and associated control system at predetermined positions along the pipeline length, for example, attached to pig trap valving or near pumping stations FIG. 10 illustrates a number of separate remote control applications, even though these will typically not coexist, they can possibly do so.

Pipeline pigs, for example, are widely used for inspection of pipeline sections. For this purpose, a pig 126 having an instrumentation trailer 128 and sized to mate in sliding relation within the pipeline 120 is transported alone the pipeline under pressure from the internal flowing media 122. A self-contained power supply and control circuits on the pig 126 and/or the instrumentation trailer 128 can be actuated by encoded signals from the $N_2$ gun 124, whatever the position along the pipeline length, since the media 122 provides excellent pressure impulse signal transmission. The pig 126 can be commanded to stop by expansion of peripheral members against the interior wall of the pipeline 120, so that the instrumentation trailer 128 can conduct a stationery inspection using magnetization, for example, If the inspection can be done while in motion, the instrumentation trailer 128 is simply commanded to operate.

Alternatively, expandable pigs having internal power supplies and control circuitry can be immobilized at spaced apart positions upstream and downstream of a leak, so that a repair procedure can be carried out, following which the pigs can be commanded to deflate and move downstream to some removal point.

It is now common to transport cleaning pigs along the interior of a pipeline, with the pigs sized to scrape scale and accumulated deep debris off the interior pipeline wall. Such a pig 130 may become stuck, in which event pressure impulse control signals may be transmitted to actuate internal mechanisms Which impart thrust so as to effect release, or reduce the pig diameter in some way such as with explosives. Such cleaning pigs 130 are also constructed so as to disintegrate with time, which action can be accelerated by pressure impulse triggering signals actuating an internal explosive charge.

This is one type of "disappearing pig" for cleaning applications, known as the "full bore" type. However, undersized pigs 132, usually of polyurethane, are also run through a pipeline with the anticipation that they will not get stuck by scale or debris. If they do get stuck, such an undersized pig 132 gradually dissolves with pressure and time, although this action can be greatly accelerated by the use of the pressure impulse signals as described above.

In a number of applications required for pipeline operation, such as dewatering, it is desirable to be able to control a remote unit, such as a check valve. Here again, the pressure impulse signals can be used efficiently, since they can transmit a detectable signal for miles within the pipeline 120, to be received by a remote control valve 136, for example.

FIGS. 11–14 depict alternate embodiments of impulse transmitting systems of the present invention. Each of the embodiments depicted therein take advantage of the existing tubing pressure that is typically available during well bore operations. The embodiments depicted in FIGS. 11–14 are suitable for attachment to wellhead 12 of FIG. 1 and may be coupled to shut off valve 17 via flange 19 or other suitable connections such that communication is established with tubing pressure or casing pressure.

Figure 11:
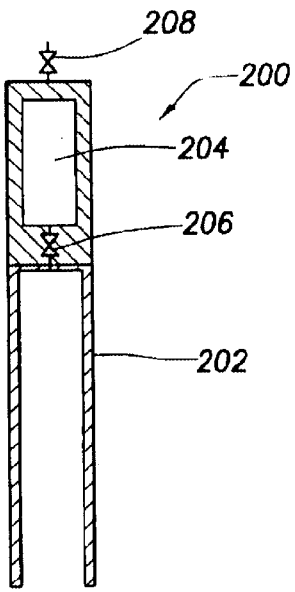

Referring specifically to FIG. 11, a schematic illustration of an impulse generating system for generating negative pressure impulses is depicted and generally designated 200. Impulse generating system 200 is mounted on tubing 202 and includes a pressure chamber 204 and a pair of valves 206 and 208. Valve 206 selectively provides a communication path between the fluid pressure within tubing 202 and chamber 204. Valve 206 is preferably a quick opening shooting valve that may be open to provide a sudden decrease in pressure in the fluid media within tubing 202 that propagates down through the fluid media within tubing 202 as a negative pressure impulse. Valve 208 is used to return chamber 204 to atmospheric pressure such that another negative pressure impulse may be generated by impulse generating system 200. Impulse generating system 200 of the present invention is operable when the fluid media within tubing 202 comprises a compressible fluid such as gas or air, and a substantially incompressible fluid such as oil, water or drilling mud or a combination of a compressible fluid cap above a substantially incompressible fluid including a fluid interface. Impulse generating system 200, however, is preferably operated when a compressible fluid is available to pass from tubing 202 into chamber 204.

In operation, valve 206 is closed to isolate tubing 202 from chamber 204. Valve 203 is opened to place chamber 204 at atmospheric pressure. Valve 208 is then closed to seal off chamber 204. Valve 206 is quickly opened to allow fluid from tubing 202 to rapidly fill chamber 204. This rapid movement of fluid from tubing 202 into chamber 204 generates the negative pressure impulse that propagates through the fluid media within tubing 202. As the composition of the fluid media within tubing 202 is typically known, the volume of chamber 204 and the operating parameters of valve 206 may be selected or adjusted such that the energy of the negative pressure impulse will be sufficient to reach the desired remote location.

It should be noted that operating parameters, such as the physical characteristics of the media at the impulse generating system 200, the pressure level of the media relative to some ambient or negative pressure, and the character and dimensions of the media through which the impulse must pass, must be taken into account in selecting the volume of the chamber 204, the size of the orifice allowing communication between the tubing 202 and the chamber 204, and the operating rate of the valve 206. Density and viscosity must also be considered if an incompressible medium is present. Properly balanced with respect to known downhole conditions, these factors will assure that adequate impulse energy is delivered for detection at the remote location.

In consequence of the rapid fluid interchange, the first incremented pressure variation is negative going, followed by a positive-going variation, and this cycling may continue briefly for a controlled interval.

Figure 12:
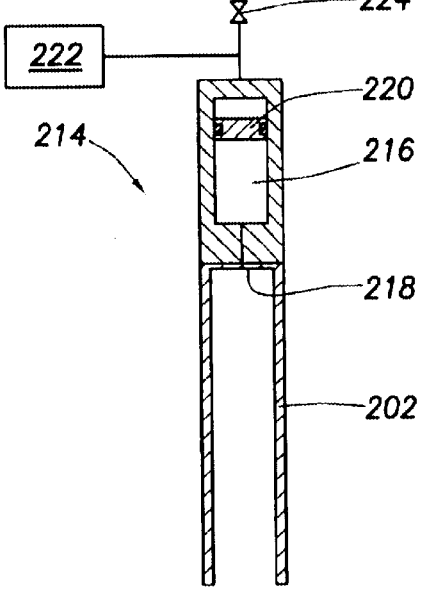
FIGS. 11–14 are schematic illustrations of impulse generating systems of the present invention.

Referring now to FIG. 12, another impulse generating system is schematically depicted and generally designated 214. Impulse generating system 214 is suitably coupled with tubing 202 such that there is fluid communication between tubing 202 and chamber 216 via passageway 218. Chamber 216 includes a flying piston 220 that is slidably engaged against the inner circumference of chamber 216. A control system, including control for a pressure source 222 and a valve 224, is coupled to chamber 216. Pressure source 222 may contain a commercially available inert and nonflammable gas such as nitrogen in high pressure nitrogen bottles. Alternatively, for higher pressure applications, a pump may be used to provide pressurized gas or liquid to chamber 216. Valve 224 is preferably a quick opening valve.

In operation, valve 224 may be opened such that pressure from tubing 202 will enter chamber 216 through passageway 218 forcing flying piston 220 to the top of chamber 216. Valve 224 is then closed and pressure source 222 provides pressure above flying piston 220 such that flying piston 220 will travel to the bottom of chamber 216. Once flying piston 220 is at the bottom of chamber 216 and pressure source 222 is turned off, valve 224 may be opened such that pressure from tubing 202 will force flying piston 220 to travel rapidly to the top of chamber 216 thereby generating a negative pressure impulse which propagates through the fluid media in tubing 202. Additional pressure impulses may be generated by repeating the above procedure such that a sequence of negative pressure impulses may be used to create a signal.

Parameters such as the volume of chamber 216, the diameter of passageway 218 and the size of valve 224 are determined based upon the composition and properties of the fluid media within tubing 202, the pressure within the tubing 202, and the energy required to propagate the negative pressure impulse to the desired remote location. Impulse generating system 214 is suitable in general for use with any of the above described fluid media within tubing 202, although suitable modifications must be made to account for the fact that the fluid media traveling through passageway 218 is compressible or substantially incompressible.

Figure 13:
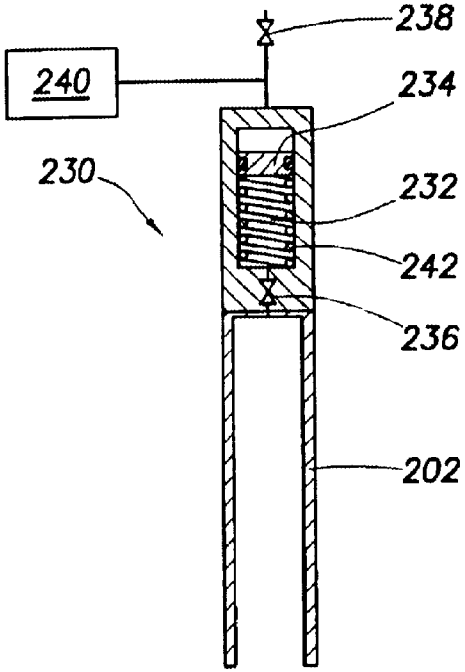

FIG. 13 is a schematic illustration of another impulse generating system that is generally designated 230. Impulse generating system 230 includes a chamber 232, a piston 234, a pair of valves 236, 238 and a pressure source 240. A spring 242 is used to upwardly bias piston 234 within chamber 232. Impulse generating system 230 is suitably coupled to tubing 202 such that a path of fluid communication may be created between-tubing 202 and chamber 232 when the valve 236 is open.

Impulse generating system 230 is operated by opening valve 238 to expose the top of piston 234 to atmospheric pressure. Spring 242 moves piston 234 to the top of chamber 232. Valve 236, preferably a fast opening shooting valve, is then opened to expose the bottom of piston 234 to fluid pressure from tubing 202 such that chamber 232 is filled with fluid from tubing 202. Valve 238 is then closed to isolate chamber 232 from atmospheric pressure. Pressure source 240 is operated to push piston 234 against spring 242 and toward the bottom of chamber 232. Once piston 234 has reached the desired level of travel toward the bottom of chamber 232, valve 236 is closed to isolate chamber 232 from the fluid pressure within tubing 202. Valve 238 may now be opened to release the pressure from chamber 232 on top of piston 234. Spring 242 will bias piston 234 toward the top of chamber 232 thereby creating a vacuum within the lower section of chamber 232. Valve 236 is then opened to allow fluid from tubing 202 to rapidly fill chamber 232 which generates a negative pressure impulse that propagates through the fluid media within tubing 202.

It should be noted that impulse generating system 230 does not require piston 234 to move rapidly in order to move fluid from tubing 202 into chamber 232. The maximum flow rate of fluid into chamber 232 is therefore determined by the size of the opening in valve 236 without considering the effects of seal friction and inertia of a rapidly moving piston. As with impulse generating system 214 of FIG. 12, impulse generating system 230 may be used to generate negative pressure impulses in any fluid media discussed herein.

Figure 14:
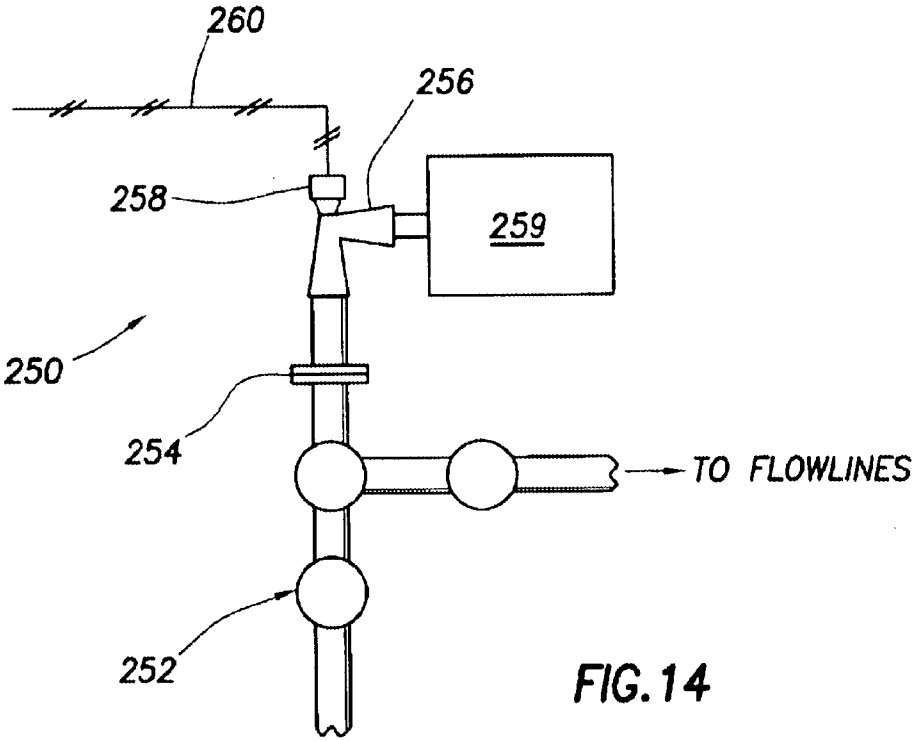

Now turning to FIG. 14, an impulse generating system 250 is depicted including a control system. Impulse generating system 250 is attached to well head 252 at flange 254. Impulse generating system 250 includes valve 256 and chamber 258. The operation of valve 256 is controlled by pneumatic controller 259 that is coupled to pneumatic control line 260. Alternatively, it should be noted that valve 256 may be controlled using other controllers such as a computer operated controller. Negative pressure impulses are generated using impulse generating system 250 by opening valve 256 for a short interval and allowing tubing pressure to enter chamber 258. In this embodiment, chamber 258 is sized such that valve 256 may be operated to generate a sequence of negative pressure impulses without discharging chamber 258. This configuration allows for the rapid sequencing of negative pressure impulses by simply opening and closing valve 256.

FIGS. 15–18 schematically depict reception apparatus for detecting changes in fluid density caused by pressure impulses in the media at a reception node. This type of reception apparatus is preferably operated in a compressible fluid media, but may also be operated in a substantially incompressible fluid media. Fluid density measurements are taken by measuring the speed of sound in the fluid media. The fluid density of the fluid media will be altered by the propagation of a pressure impulse therethrough. Thus, detection of the pressure impulses may be achieved using fluid density measurements Referring specifically to FIG. 15, a reception node 280 comprising an acoustic transmitter 282 and an acoustic receiver 284 disposed on opposite walls within tubing 286 is depicted, as may be disposed at a remote location. Tubing 286 is filled with a fluid media which may be a compressible fluid or a substantially incompressible fluid, and through which the pressure impulse is propagated. Acoustic pulses 290 are generated by the acoustic transmitter 282 and are detected by the acoustic receiver 284. Acoustic transmitter 282 may be turned on using a variety of techniques including the use of a pressure impulse as described herein. Once acoustic transmitter 282 has been turned on, acoustic transmitter 282 may transmit acoustic pulses at a suitable rate to provide the required sensitivity to detect pressure impulses propagating through the fluid media 288. Both the presence of and the energy level of the pressure impulses may be detected using fluid density measurements. These valves can then be employed in controlling tools at the remote location, or for other purposes.

Figure 16:
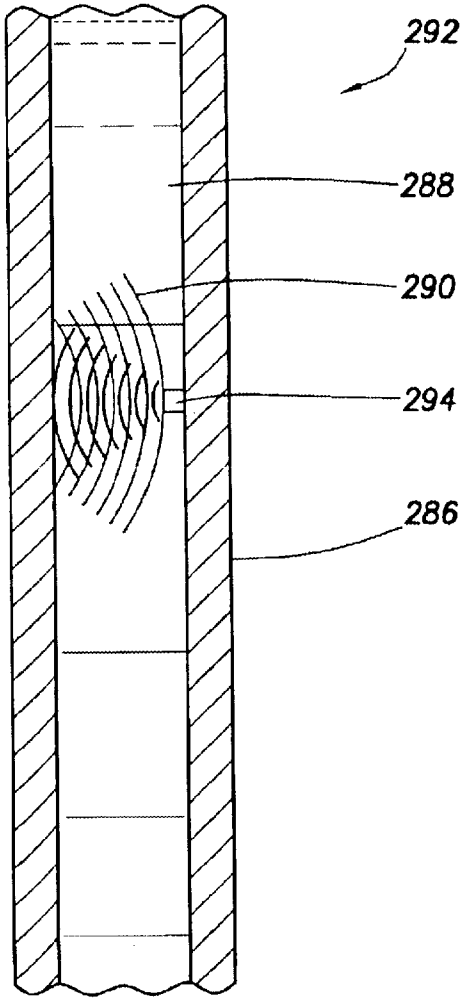
FIGS. 15–18 are schematic illustrations of fluid density transducers for use in conjunction with the system of the present inventions.
Figure 15:
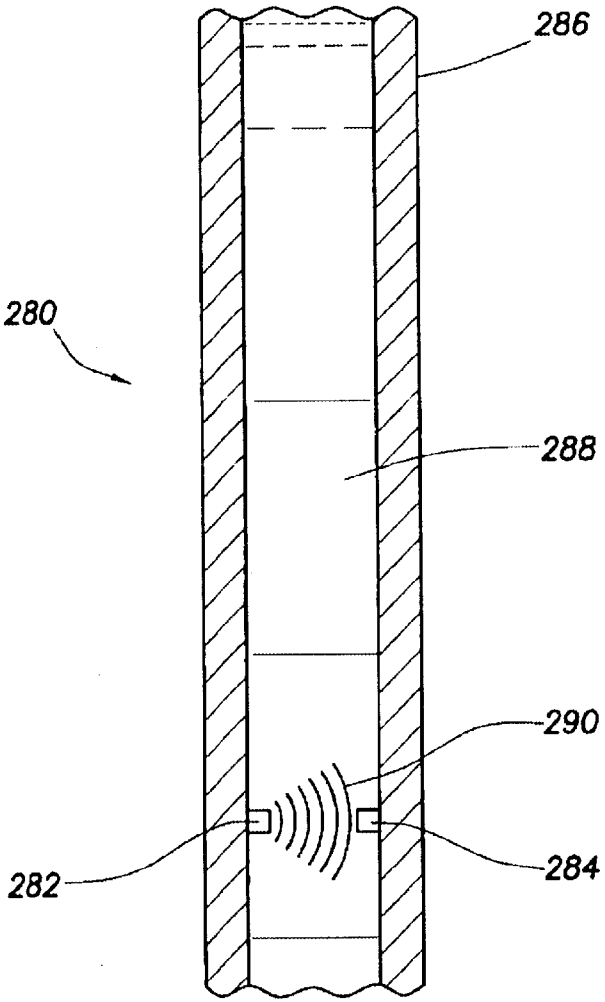

Referring now to FIG. 16, a reception node 292 is schematically depicted. Reception node 292 includes an acoustic transmitter/receiver 294 disposed within tubing 286 having a fluid media 288 therein. The acoustic transmitter/receiver sends and receives acoustic pulses 290 which are reflected off the opposite side of the interior of tubing 286. In this configuration, the fluid density measurement system lengthens the path of travel of the acoustic pulses 290 thereby improving the sensitivity of the fluid density measurement.

Figure 17:
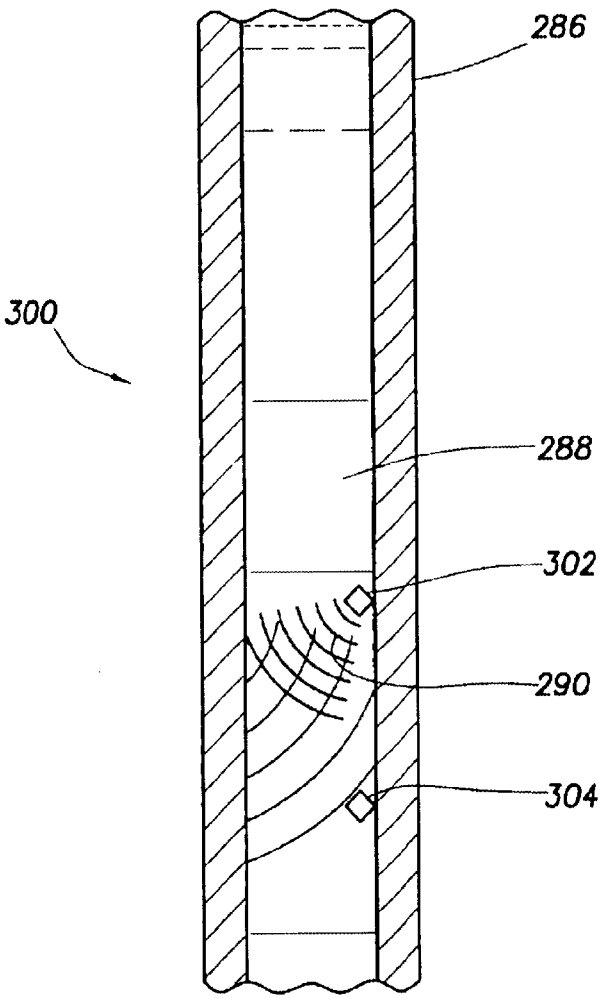

Referring now to FIG. 17, another embodiment of a fluid density measurement system for sensing the influence of impulses at a remote location, is depicted at reception node 300. Reception node 300 includes an acoustic transmitter 302 and an acoustic receiver 304 which are disposed on the same side of tubing 286. Tubing 286 is filled with a fluid media 288 through which a pressure impulse may propagate. In this embodiment, acoustic pulses 290 are sent from acoustic transmitter 302 and reflected off of tubing 286 to acoustic receiver 304. Again, this embodiment allows for the lengthening of the path of travel of the acoustic pulses 290 thereby improving the sensitivity of the fluid density measurement. Alternatively, an acoustic transmitter/receiver similar to that depicted in FIG. 16 may be used to measure the velocity of small particles in a fluid media. This type of system utilizes the Doppler technique to determine velocity.

Figure 18:
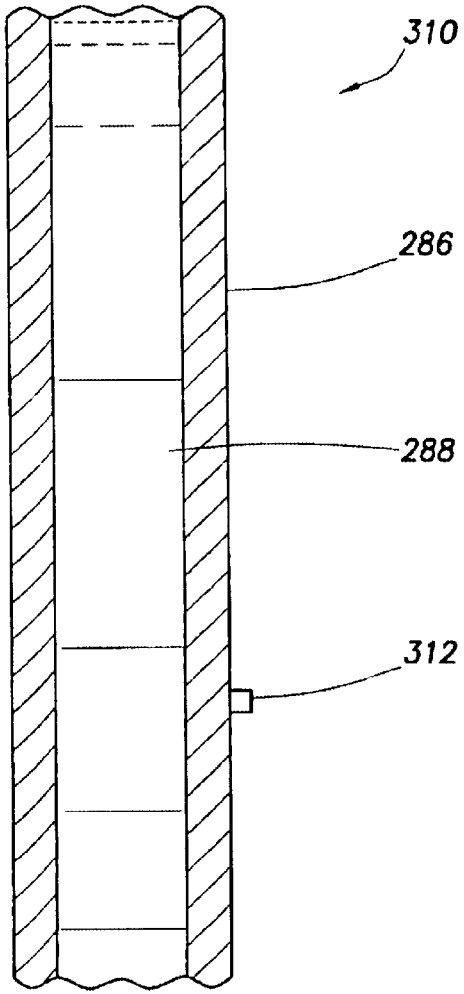

Now referring to FIG. 18, an alternate method for detecting the propagation of pressure impulses is depicted at reception node 310. An accelerometer 312 is placed on the outside of tubing 286. Within tubing 286 is a fluid media 288 through which pressure impulses may be transmitted. As the pressure impulses travel through tubing 286, radial flexure of tubing 286 occurs. These small radial accelerations of tubing 286 are detected by accelerometer 312 as an indication of the pressure impulses traveling within tubing 286.

Figure 20:
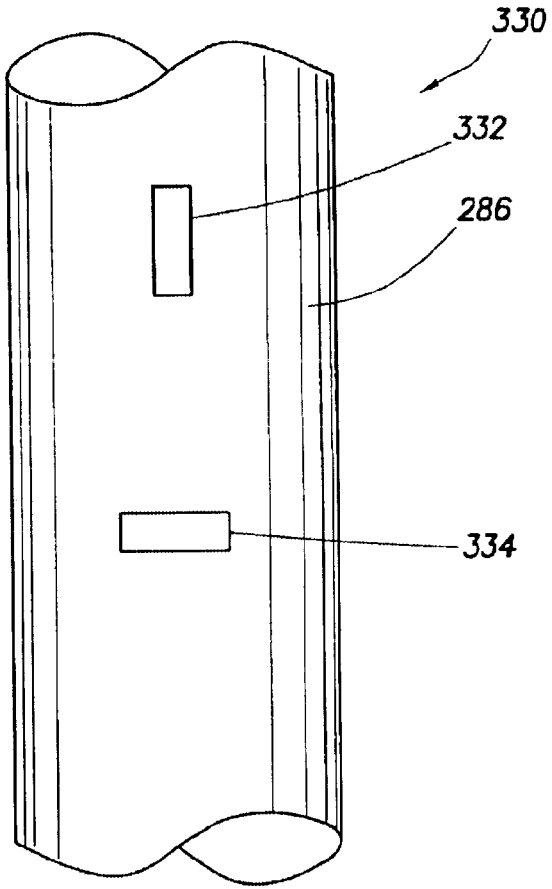
FIGS. 19–20 are schematic illustrations of strain gauge arrangements used to detect changes in stresses in a tubular system for use in conjunction with the system of the present invention.
Figure 19:
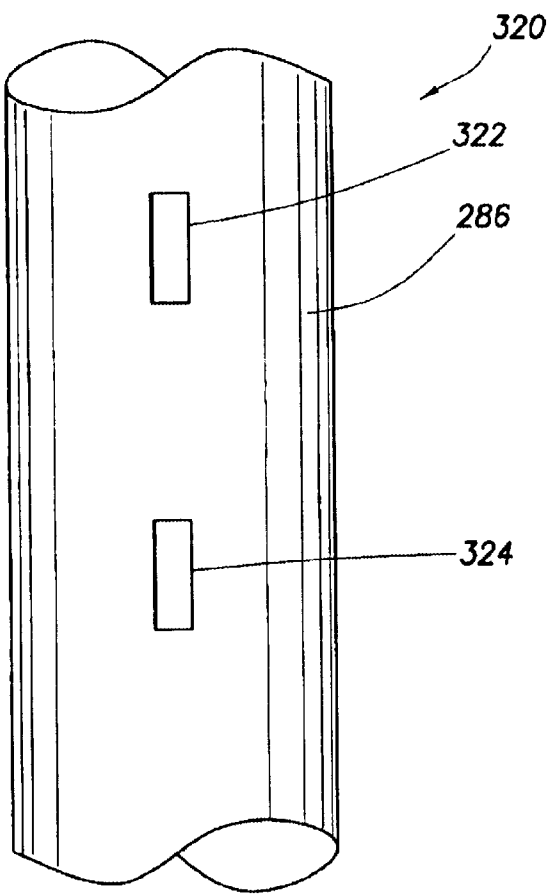

In FIGS. 19 and 20 strain gauges are applied to the exterior of the tubular system to monitor changes in the stresses of the tubular system indicated by changes in resistance within the strain gauge. In FIG. 19, strain gauges 322, 324 are disposed on the exterior of tubing 286 at reception node 320. As pressure impulses travel through the tubing 286, longitudinal stresses occur within tubing 286. These longitudinal stresses are detected by strain gauges 322 and 324 which will be represented as changes in resistance. Alternatively, as depicted in FIG. 20, strain gauges 332 and 334, at reception node 330, may be used to detect not only the longitudinal stress within tubing, 286, but also the hoop or circumferential stress within tubing 286. Pressure impulses propagating through the fluid media within tubing 286 will cause both longitudinal stress and circumferential stress to occur within tubing 286. The circumferential stress associated with a pressure impulse is typically greater than the longitudinal stress and may therefore be easier to detect using strain gauges such as strain gauge 334.

Although a number of different applications have been illustrated and identified for pressure impulse signal control of remote tools and other equipment, many other applications are possible. For example, hydraulic pressure-operated tools employed in drill stem testing and tubing conveyed perforating operations can advantageously be supplanted by pressure impulse actuation, thus minimizing the possibilities of accidental actuation of pressure-operated elements. Rapid sequencing control for "OMNI" valves can be accomplished more rapidly and reliably using pressure impulse control signals. In gravel pack screen isolation tubing, flapper valves or sleeves can be efficiently operated. A number of other applications will suggest themselves to those skilled in the art.

The energy level and profiles of the pressure impulses generated by the various impulse generating systems of the present invention overcome the problems of transmission in a fluid media having both a compressible fluid and a substantially incompressible fluid therein. It had previously been thought that the interface between these different media would necessarily reflect the great majority of a pressure impulse. Indeed, theory indicated that less than 2–6% would penetrate the barrier, thereby making a pressure impulse generating system impractical. The pressure impulse generating system of the present invention, however, transmits pressure impulses into the fluid media within a tubular system that propagate therethrough including penetrating through different interfaces between different media.

The down hole detector or detectors must be leak proof under the pressure and temperature conditions likely to be encountered at substantial depth in bore holes. Modern instrumentation and transducer technology provides a range of sensitive and reliable additional methodologies for responding to minute pressure or velocity variations. For sometime, small diffraction grating and interferometer devices have been employed for sensing strain variations. In these devices a small laser directs a beam toward the grating or interferometer, providing a signal responsive to minute physical displacements under strain that can be detected and analyzed to indicate the amplitude of the physical perturbation.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method of communicating in a tubular system between a transmission node and a reception node through media disposed therein, the media of both compressible and incompressible fluid, the method comprising the steps of:

providing a transmission apparatus at the transmission node, said transmission apparatus being in communication with the media, the media at the transmission node comprising an incompressible fluid;

providing a reception apparatus at the reception node, said reception apparatus being in communication with the media, the media at the reception node comprising a compressible fluid;

generating at least one impulse in the incompressible fluid with the transmission apparatus; and detecting the at least one impulse with the reception apparatus.

2. The method as recited in claim 1 wherein the step of generating at least one impulse further comprises propagating at least one incremental pressure increase followed by at least one corresponding incremental pressure decrease through the media.

3. The method as recited in claim 1 wherein the step of generating at least one impulse further comprises propagating at lest one incremental pressure decrease followed by at least one corresponding incremental pressure increase through the media.

4. The method as recited in claim 1 wherein the step of detecting the at least one impulse further comprises detecting variations in the fluid density of the media at the reception node.

5. The method as recited in claim 1 wherein the step detecting the at least one impulse further comprises detecting variations in pressure at the reception node.

6. The method as recited in claim 1 wherein the step of detecting the at least one impulse further comprises detecting variations in stress of the tubular system at the reception node.

7. The method as recited in claim 1 wherein the step of detecting the at least one impulse further comprises detecting variations in the acceleration of the tubular system at the reception node.

8. The method as recited in claim 1 wherein the media further comprises one interface between compressible and incompressible fluid.

9. The method as recited in claim 1 wherein the media further comprises at least one interface between compressible fluid and incompressible fluid.

10. The method as recited in claim 1 further comprising the step of generating a signal for actuating a controllable device proximate the reception node.

11. The method as recited in claim 10 wherein the step of generating at least one impulse further comprises generating a plurality of impulses in a predetermined pattern and comparing the pattern of impulses to information stored in a control system.

12. A method as in claim 1 wherein the tubular system comprises a subterranean well.

13. A method as in claim 1 wherein the tubular system comprises a pipeline.

14. A method of communicating in a tubular system through both incompressible and compressible media disposed therein comprising the steps of:

generating at least one impulse in incompressible media;

propagating the at least one impulse across an interface between incompressible and compressible media; and detecting the at least one impulse at a remote location along the tubular system, the remote location in compressible media.

15. The method as recited in claim 14 wherein the step of generating at least one impulse further comprises propagating at least one incremental pressure decrease followed by at least one corresponding incremental pressure increase through the media.

16. The method as recited in claim 14 wherein the step of detecting the at least one impulse further comprises detecting variations in the fluid density of the media at the remote location.

17. The method as recited in claim 14 wherein the step of detecting the at least one impulse further comprises detecting variations in pressure in the tubular system at the remote location.

18. The method as recited in claim 14 wherein the step of detecting the at least impulse further comprises detecting variations in the stress of the tubular system at the remote location.

19. The method as recited in claim 14 wherein the step of detecting the at least one impulse further comprises detecting variations in the acceleration of the tubular system at the remote location.

20. The method as recited in claim 14 wherein the step of propagating further comprises propagating the at least one impulse across at least one interface between incompressible and compressible media.

21. The method as recited in claim 14 wherein the step of generating at least one impulse further comprises generating a plurality of impulses in a predetermined pattern.

22. The method as recited in claim 14 further comprising the step of generating a signal of actuating a controllable device proximate the remote location.

23. A method as in claim 14 wherein the tubular system comprises a subterranean well.

24. A method as in claim 14 wherein the tubular system comprises a pipeline.

25. A method of communicating in a tubular system through both incompressible and compressible media disposed therein comprising the steps of:

generating at least one impulse in compressible media; propagating the at least one impulse across an interface between incompressible and compressible media; and detecting the at least one impulse at a remote location along the tubular system, the remote location in incompressible media.

26. The method as recited in claim 25 wherein the step of generating at least one impulse further comprises propagating at least one incremental pressure decrease followed by at least one corresponding incremental pressure increase through the media.

27. The method as recited in claim 25 wherein the step of detecting the at least one impulse further comprises detecting variations in the fluid density of the media at the remote location.

28. The method as recited in claim 25 wherein the step of detecting the at least one impulse further comprises detecting variations in pressure in the tubular system at the remote location.

29. The method as recited in claim 25 wherein the step of detecting the at least one impulse further comprises detecting variations in the stress of the tubular system at the remote location.

30. The method as recited in claim 25 wherein the step of detecting the at least one impulse further comprises detecting variations in the acceleration of the tubular system at the remote location.

31. The method as recited in claim 25 wherein the step of propagating further comprises propagating the at least one impulse across at least one interface between incompressible and compressible media.

32. The method as recited in claim 25 wherein the step of generating at least one impulse further comprises generating a plurality of impulses in a predetermined pattern.

33. The method as recited in claim 25 further comprising the step of generating a signal for actuating a controllable device.

34. The method as in claim 25 wherein the tubular system comprises a subterranean well.

35. The method as in claim 25 wherein the tubular system comprises a pipeline.

36. An apparatus for communicating in a tubular system between a transmission node and a reception node through both compressible and incompressible media disposed therein comprising:

a transmission apparatus at the transmission node, the transmission apparatus in communication with the incompressible media; and a reception apparatus at the reception node, the reception apparatus in communication with the compressible media, wherein during a communication mode of operation, the transmission apparatus generates at least one impulse in the media and the reception apparatus detects the at least one impulse.

37. The apparatus as recited in claim 36 wherein the at least one impulse further comprises at least one incremental pressure increase followed by at least one corresponding incremental pressure decrease that propagates through the media.

38. The apparatus as recited in claim 36 wherein the at least one impulse further comprises at least one incremental pressure decrease followed by at least one corresponding incremental pressure increase that propagates through the media.

39. The apparatus as recited in claim 36 wherein the reception apparatus detects variations in the fluid density of the media at the reception node.

40. The apparatus as recited in claim 36 wherein the reception apparatus detects variations in the longitudinal stress of the tubular system at the reception node.

41. The apparatus as recited in claim 36 wherein the reception apparatus detects variations in the circumferential stress of the tubular system at the reception node.

42. The apparatus as recited in claim 36 wherein the reception apparatus detects variations in the pressure of the tubular system at the reception node.

43. The apparatus as recited in claim 36 further comprising a controllable device within the tubular system proximate the reception node that is actuated in response to the detection of the at least one impulse by the reception apparatus.

44. The apparatus as recited in claim 36 wherein the at least one impulse further comprises a plurality of impulses in a predetermined pattern that are compared to information stored in a control system.

45. An apparatus as in claim 36 wherein the tubular system comprises a subterranean well.

46. An apparatus as in claim 36 wherein the tubular system comprises a pipeline.

47. The apparatus as recited in claim 36, the tubular system having at least one interface between incompressible and compressible media.

48. An apparatus for communicating in a tubular system through both compressible and incompressible media disposed therein comprising:

a transmission apparatus for generating at least one impulse in the incompressible media by removing a portion of the compressible media from the tubular system; and a reception apparatus at a spaced apart location along the tubular system for detecting the at least one impulse, the reception apparatus in communication with the compressible media.

49. The apparatus as recited in claim 48, wherein the at least one impulse further comprises at least one incremental pressure increase followed by at least one corresponding incremental pressure decrease that propagates through the media.

50. The apparatus as recited in claim 48 wherein the at least one impulse further comprises at least one incremental pressure decrease followed by at least one corresponding incremental pressure increase that propagates through the media.

51. The apparatus as recited in claim 48 wherein the reception apparatus detects variations in the fluid density of the media at the remote location.

52. The apparatus as recited in claim 48 wherein the reception apparatus detects variations in the longitudinal stress of the tubular system at the remote location.

53. The apparatus as recited in claim 48 wherein the reception apparatus detects variations in the circumferential stress of the tubular system at the remote location.

54. The apparatus as recited in claim 48 wherein the reception apparatus detects variations in the acceleration of the tubular system at the remote location.

55. The apparatus as recited in claim 48 wherein the at least one impulse further comprises a plurality of impulses in a predetermined pattern.

56. The apparatus as recited in claim 48 further comprising a controllable device within the tubular system proximate the remote location that is actuated in response to the detection of the at least one impulse by the reception apparatus.

57. An apparatus as in claim 48 wherein the tubular system comprises a subterranean well.

58. An apparatus as in claim 48 wherein the tubular system comprises a pipeline.

59. The apparatus as recited in claim 48, the tubular system further comprising at least one interface between incompressible and compressible media.

60. A method of communicating in a tubular system having compressible and incompressible media therein, the method comprising the steps of:

generating at least one pressure impulse in the incompressible fluid; and detecting the at least one pressure impulse in the compressible fluid.

61. A method as in claim 60, further comprising the steps of providing a transmission apparatus in communication with the compressible media.

62. A method as in claim 60, further comprising the step of providing a reception apparatus in communication with the incompressible media.

63. A method as in claim 60, wherein the step of generating at least one pressure impulse further comprises generating a plurality of impulses in a coded signal.

64. A method as in claim 60, wherein the coded signal is determined by the time pattern of the plurality of impulses.

65. A method as in claim 60, wherein the step of generating at least one pressure impulse further comprises generating a signal for activating a well too; and further comprising the step of activating at least one well tool.

66. A method as in claim 60 wherein the tubular system comprises a subterranean well.

67. A method as in claim 60 wherein the tubular system comprises a pipeline.

68. A method as in claim 60 further comprising the step of propagating the at least one impulse signal across at least one interface between incompressible and compressible media.

* * * * *